US008864637B2

(12) United States Patent
Leirer

(10) Patent No.: US 8,864,637 B2
(45) Date of Patent: Oct. 21, 2014

(54) ABDOMINAL EXERCISE DEVICE

(76) Inventor: Thomas C. Leirer, Anderson, SC (US)

( * ) Notice: Subject to any disclaimer, the term of this patent is extended or adjusted under 35 U.S.C. 154(b) by 268 days.

(21) Appl. No.: 13/360,262

(22) Filed: Jan. 27, 2012

(65) Prior Publication Data

US 2013/0196834 A1 Aug. 1, 2013

(51) Int. Cl.
*A63B 21/00* (2006.01)

(52) U.S. Cl.
USPC ..... 482/121; 482/126; 482/141

(58) Field of Classification Search
USPC ..... 482/121, 126, 125, 73, 907, 130, 141
See application file for complete search history.

(56) References Cited

U.S. PATENT DOCUMENTS 4,733,861 A * 3/1988 Plunkett, III ..... 482/126
5,549,532 A * 8/1996 Kropp ..... 482/126
5,588,942 A * 12/1996 Dillard ..... 482/139
5,813,954 A * 9/1998 Wilkinson ..... 482/124
5,921,657 A * 7/1999 Case ..... 362/191
5,984,845 A * 11/1999 Powers ..... 482/148
6,190,512 B1 * 2/2001 Lantsman ..... 204/192.12
6,866,617 B2 * 3/2005 Chen ..... 482/124
7,090,627 B1 * 8/2006 Walker ..... 482/140
2006/0052223 A1 * 3/2006 Terry ..... 482/126

* cited by examiner

*Primary Examiner* — Jerome W Donnelly
(74) *Attorney, Agent, or Firm* — Nelson Mullins Riley & Scarborough, LLP

(57) ABSTRACT

An exercise device for use with a support surface includes a first elongated member defining an elongated bore extending, a second elongated member defining an elongated bore extending, the first elongated member being removably secured to the second elongated member, and an attachment assembly configured to removable secure the first and second elongated members adjacent to the support surface. A user positions a portion of the user's body between the first and second elongated members and the support surface, thereby securing the portion of the user's body in a substantially stationary position.

32 Claims, 9 Drawing Sheets

ABDOMINAL EXERCISE DEVICE

FIELD OF THE INVENTION

The present invention relates generally to exercise equipment. More particularly, the present invention relates to a device for use in performing abdominal exercises.

BACKGROUND OF THE INVENTION

In recent years, the population has become more fitness-conscious as evidenced by the increasing popularity of health, fitness and wellness products that are available to the general public. As well, the proliferation of health clubs, yoga studios, dance studios, diets, etc., and programs such as "boot camp," spin class, cross-fit, P90X, etc., are further evidence of the population's desire to attain fitness through exercise. However, access to many of these existing programs and clubs often requires membership, which can be prohibitively costly. As well, those products which are intended to be used in one's residence may also be prohibitively expensive, require a large amount of space, be complicated, time consuming and sometimes painful to use. As such, it is not uncommon for the desired results not to be achieved.

The present invention recognizes and addresses considerations of prior art constructions and methods.

SUMMARY OF THE INVENTION

One embodiment of the present disclosure provides an exercise device for use with a support surface, the device including a first elongated member having a first end, a second end and an elongated bore extending therebetween, a second elongated member having a first end, a second end and an elongated bore extending therebetween, wherein the first end of the second elongated member being removably secured to the second end of the first elongated member. An attachment assembly is configured to removably secure the first and second elongated members adjacent to the support surface. A user positions a portion of the user's body between the first and second elongated members and the support surface, thereby securing the portion of the user's body in a substantially stationary position.

Another embodiment of the present disclosure provides an exercise device for use with a support surface, the device including a first elongated member having a first end, a second end and an elongated bore extending therebetween, a strap extending through the elongated bore of the first elongated member, and a buckle having a first portion secured to a first end of the strap and a second portion secured to a second end of the strap. The strap and buckle are configured to removably secure the first elongated member adjacent to the support surface, and a user positions a portion of the user's body between the first elongated member and the support surface, thereby securing the portion of the user's body in a substantially stationary position.

Another embodiment of the present disclosure provides an exercise device for use with a support surface, the device including a first elongated member having a first end, a second end and an elongated bore extending therebetween, a second elongated member having a first end, a second end and an elongated bore extending therebetween, the first end of the second elongated member being removably secured to the second end of the first elongated member, an elongated flexible member having a first end and a second end, the elongated flexible member being configured to removably secure the first and second elongated members to the support surface, and means for connecting the first end of the elongated flexible member to the second end of the elongated flexible member. The elongated flexible member extends through the elongated bores of the first and second elongated members, and a user positions a portion of the user's body between the first and second elongated members and the support surface, thereby securing the portion of the user's body in a substantially stationary position.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
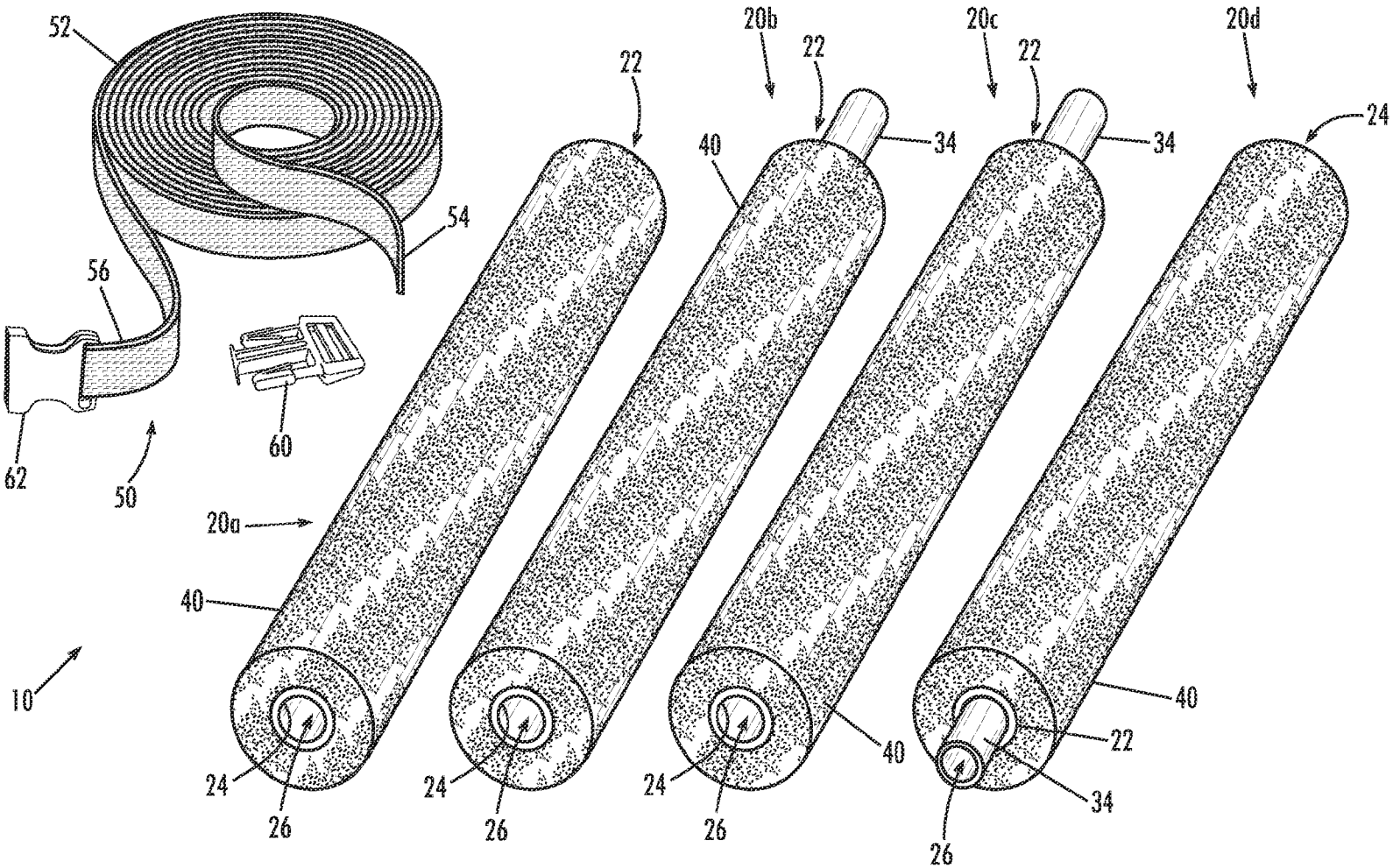
FIG. 1 is a perspective view of an unassembled abdominal exercise device in accordance with an embodiment of the present disclosure.

Repeat use of reference characters in the present specification and drawings is intended to represent same or analogous features or elements of the invention according to the disclosure.

DETAILED DESCRIPTION OF THE PREFERRED EMBODIMENTS

Reference will now be made in detail to presently preferred embodiments of the disclosure, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 5:
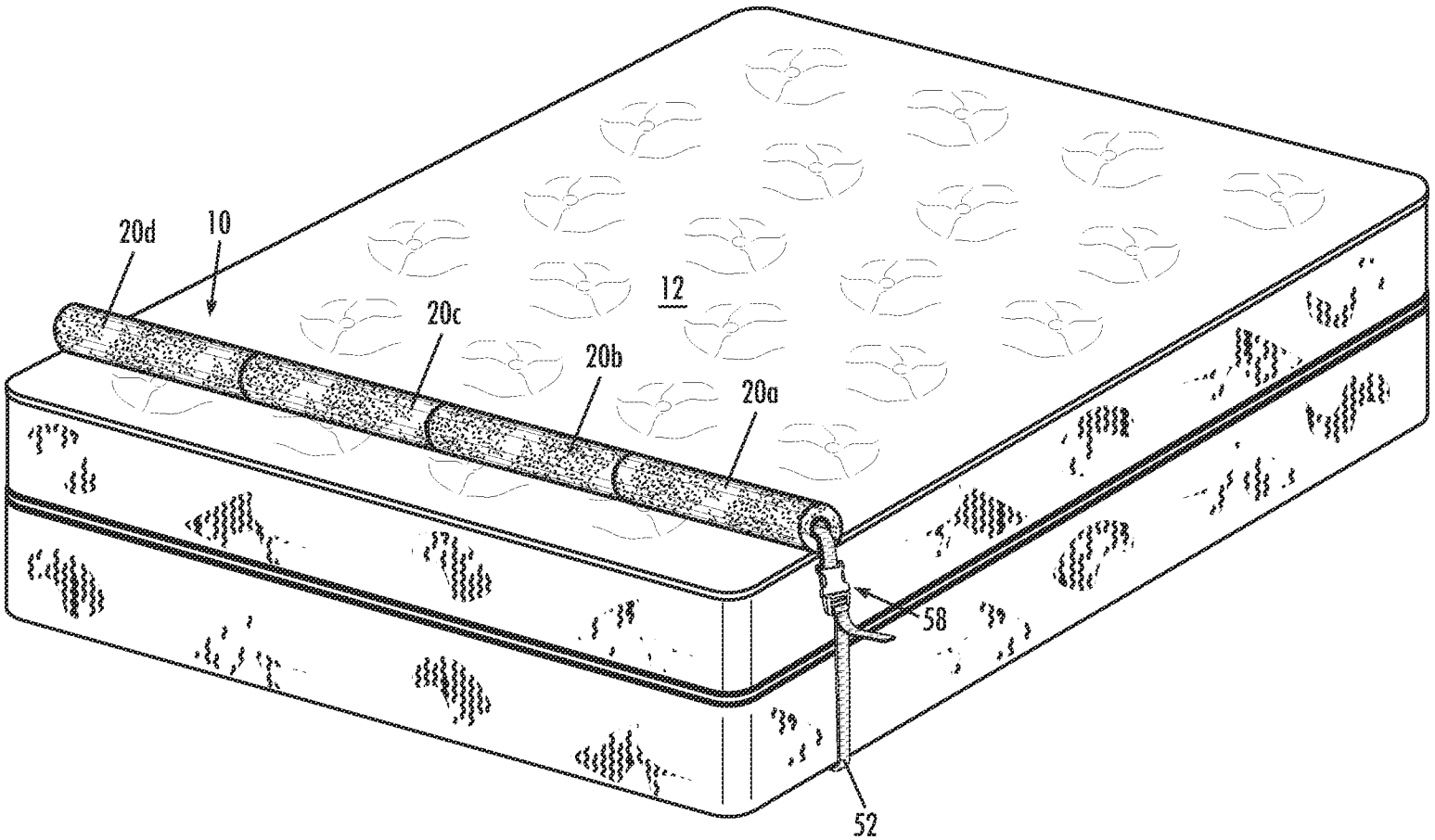
FIG. 5 is a perspective view of the abdominal exercise device, as shown in FIG. 1, secured to a support surface.
Figure 6:
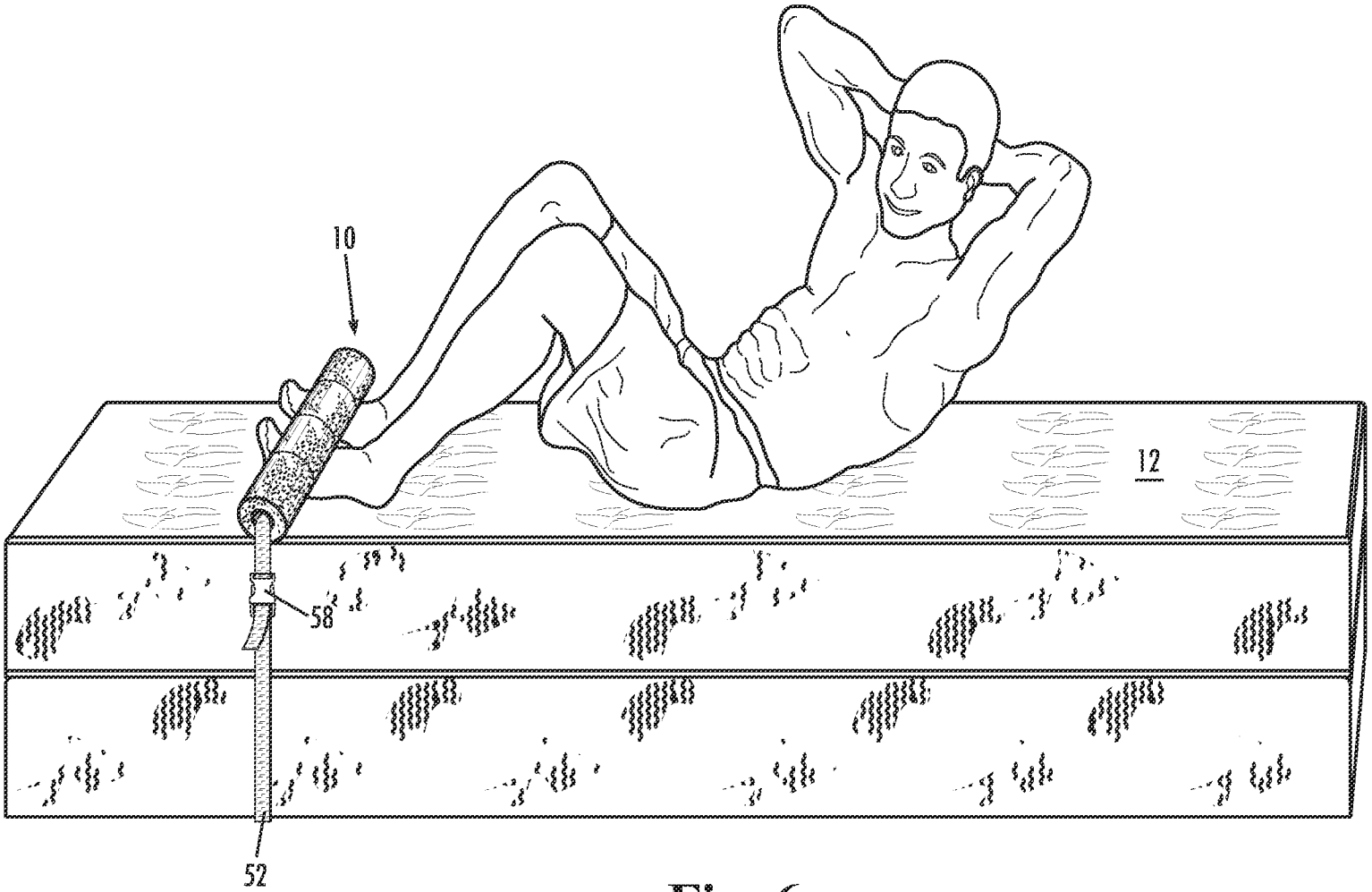
FIG. 6 is a perspective view of a user performing abdominal exercises with the abdominal exercise device, as shown in FIG. 5.

Referring now to the figures, as shown in FIG. 1, an embodiment of an abdominal exercise device 10 in accordance with the present disclosure includes at least a first elongated member 20*a*, a padded member 40 disposed thereabout, and an attachment assembly 50 for releasably securing exercise device 10 to a support surface, preferably padded, such as a mattress 12 (FIGS. 5 and 6). Additionally, as discussed in greater detail below, exercise device 10 may include additional elongated members 20*b*, 20*c* and 20*d*, dependent upon the width of the support surface to which exercise device 10 is secured.

Figure 2A:
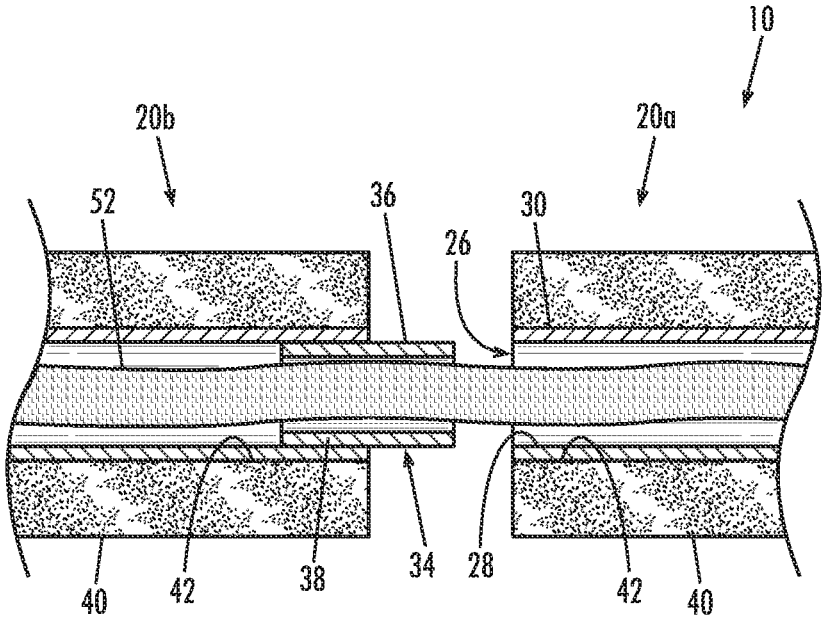
FIGS. 2A and 2B are partial, cross-sectional views of the abdominal exercise device, as shown in FIG. 1.
Figure 2B:
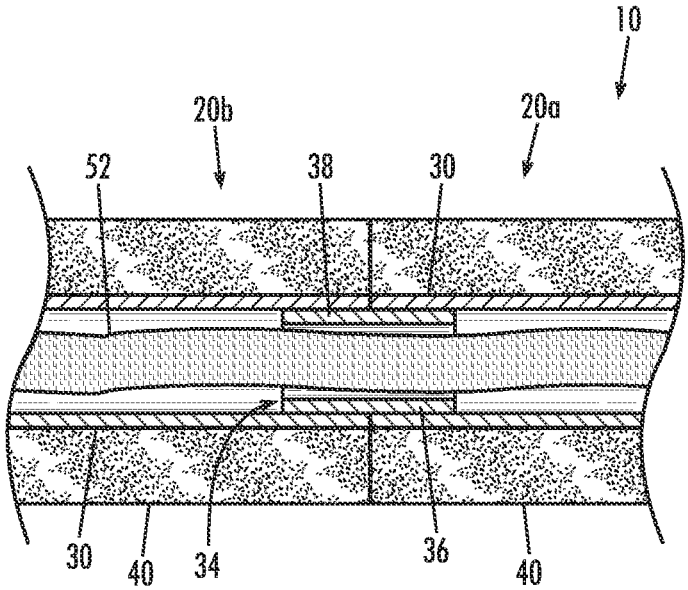

Referring additionally to FIGS. 2A and 2B, and as noted above, various configurations of exercise device 10 may include multiple elongated members. As shown, first elongated member 20*a* includes a first end 22, a second end 24, and an inner surface 28 that defines an elongated bore 26. Padded member 40 also includes an elongated bore 42 that is defined by an inner surface that is received adjacent an outer surface 30 of first elongated member 20*a*. Preferably, first elongated member 20*a* is a cylindrical metal tube measuring 19 inches in length and having a 1 inch outer diameter. The 19 inch length for the elongated members is preferable in that when exercise device 10 is secured to a standard sized mattress 12, as shown in FIGS. 5 and 6, two elongated members can be used to span a twin, three sections to span a full or queen, and four sections to span a king. Note, although the elongated members are preferably cylindrical, they may also be formed from tubes of varying cross-sectional shapes (oval, rectangular, polygonal, etc.) and materials other than steel (fiber reinforced plastic, fiberglass, etc.) that exhibit sufficient rigidity for the intended purpose.

As shown, padded member 40 is preferably cylindrical, formed of a polymer foam material, has an outer diameter of 3½ inches, and an overall length of 19 inches that corresponds to the length of first elongated member 20*a*. Elongated bore 42 of padded member 40 is correspondingly shaped to the cross-sectional shape of first elongated member 20*a*. Additionally, the external cross-sectional shape of padded member 40 may be varied (oval, rectangular, polygonal, etc.)

In the configuration of exercise device 10 shown in FIGS. 2A and 2B, at least a second elongated member 20*b* is utilized. Second elongated member 20*b* differs only from first elongated member 20*a* in that a connector stub 34 is received in its elongated bore 26 at its first end 22. Connector stub 34 is sized and configured such that a first portion 36 of connector stub 34 is received in elongated bore 26 of second elongated member 20*b* in a press-fit. Preferably, the press-fit of first portion 36 in elongated bore 26 is sufficient to prevent removal of connector stub 34 from second elongated member 20*b*. However, dependent upon the materials used to construct connector stub 34 and the corresponding elongated member, first portion 36 of connector stub 34 may be further secured in the elongated bore 26 by welding, gluing, crimping, staking, etc. A second portion 38 of connector stub 34 is removably received in elongated bore 26 of first elongated member 20*a* at its second end 24 in an interference fit. As such, first elongated member 20*a* and second elongated member 20*b* are selectively connectable by the user in the interference fit, thereby preventing their separation until an adequate amount of force in opposing axial directions is applied by the user.

Figure 3:
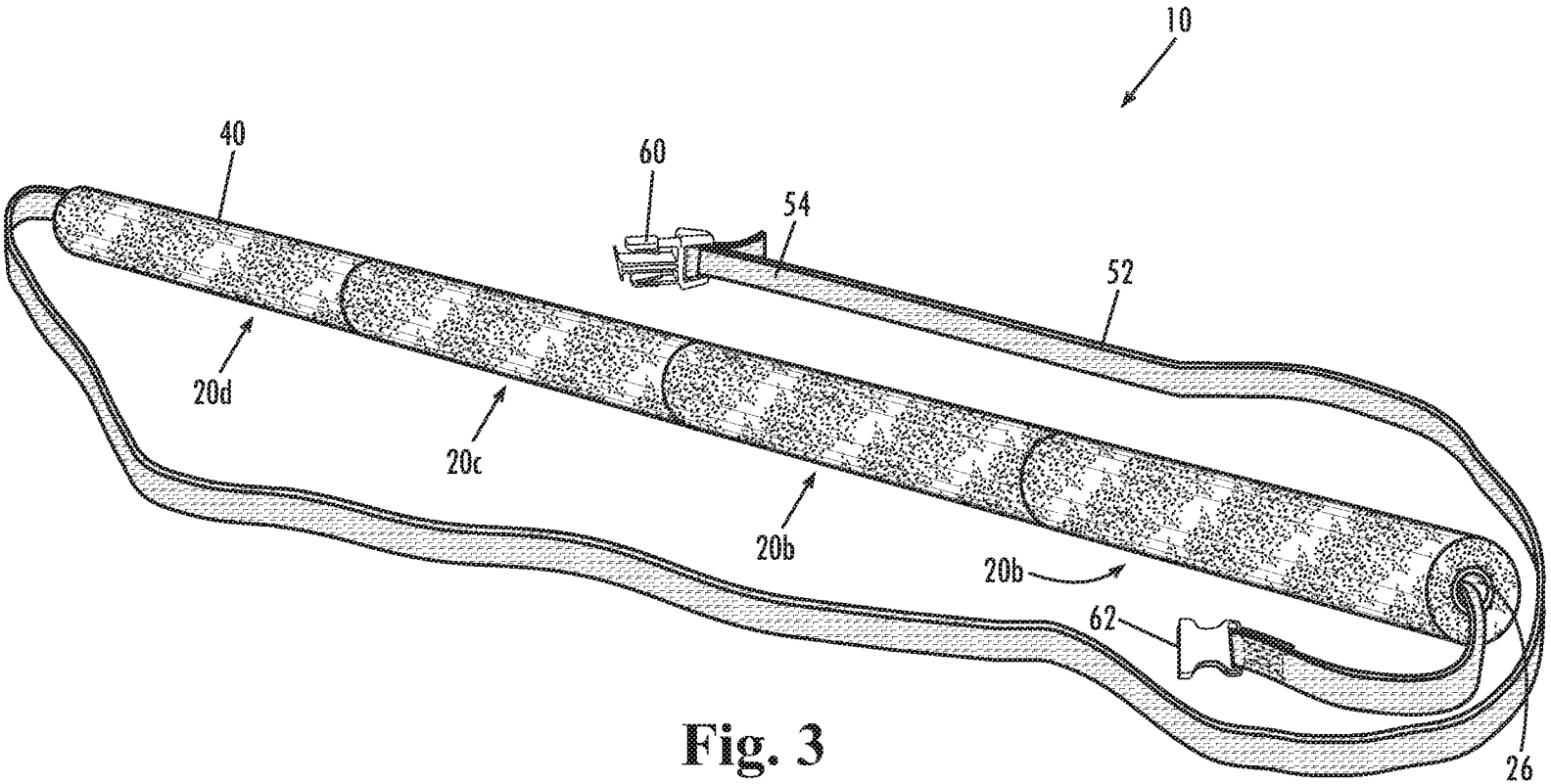
FIG. 3 is a perspective view of the abdominal exercise device, as shown in FIG. 1, in a fully assembled state.
Figure 4:
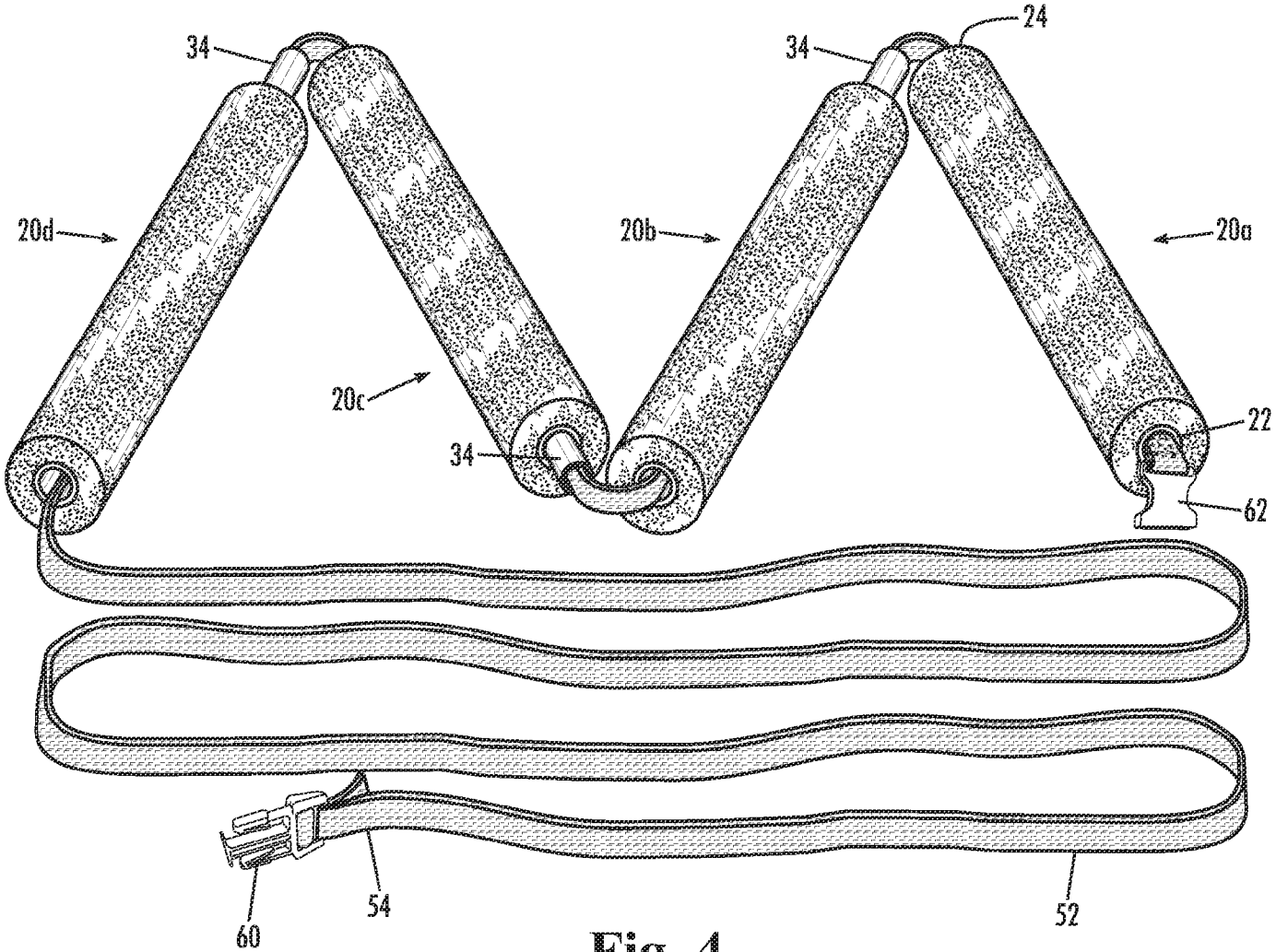
FIG. 4 is a perspective view of the abdominal exercise device, as shown in FIG. 1, in a collapsed state to allow for storage.

Referring additionally to FIGS. 3 and 4, attachment assembly 50 includes a strap 52 with a first end 54 and a second end 56, and a buckle 58 with a first male portion 60 secured to first end 54 of strap 52 and a second female portion 62 attached to second end 56 of strap 52. As shown in FIG. 1, male end 60 of buckle 58 is selectively removable from strap 52. This is desirable in order to facilitate threading strap 52 through elongated bores 26 of the various elongated members 20*a*, 20*b*, 20*c* and 20*d*, that may be used in a specific configuration of abdominal exercise device 10. After first end 54 of strap 52 has been threaded through the elongated bores of the elongated members, male end 60 is secured to strap 52 and the desired length of strap 52 may be adjusted by sliding one, or both, of first and second portions 60 and 62 along the length of strap 52.

Preferably, strap 52 is comprised of nylon and is 18 feet in length and 1½ inches in width, whereas buckle 58 is constructed of plastic. Alternate materials may be used for both the strap and the buckle. The length of strap 52 allows exercise device 10 to be used on mattresses 12 (FIGS. 5 and 6) that range in size from a single up to a king. As shown, strap 52 is preferably passed under the box spring on which mattress 12 is supported to provide additional stability. As well, the length of strap 52 allows the user to position the strap around the bed frame on which mattress 12 and box spring are positioned if desired. Strap 52 can be threaded through the corresponding elongated bores 26 either prior to (FIG. 4) or after (FIG. 3) the various elongated members 20*a*, 20*b*, 20*c* and 20*d* are secured to each other. Note, attachment assembly 50 can also be used to attach the exercise device support surfaces other than bedding, for example, but not limited to, couches, lounge chairs, etc.

Figure 7A:
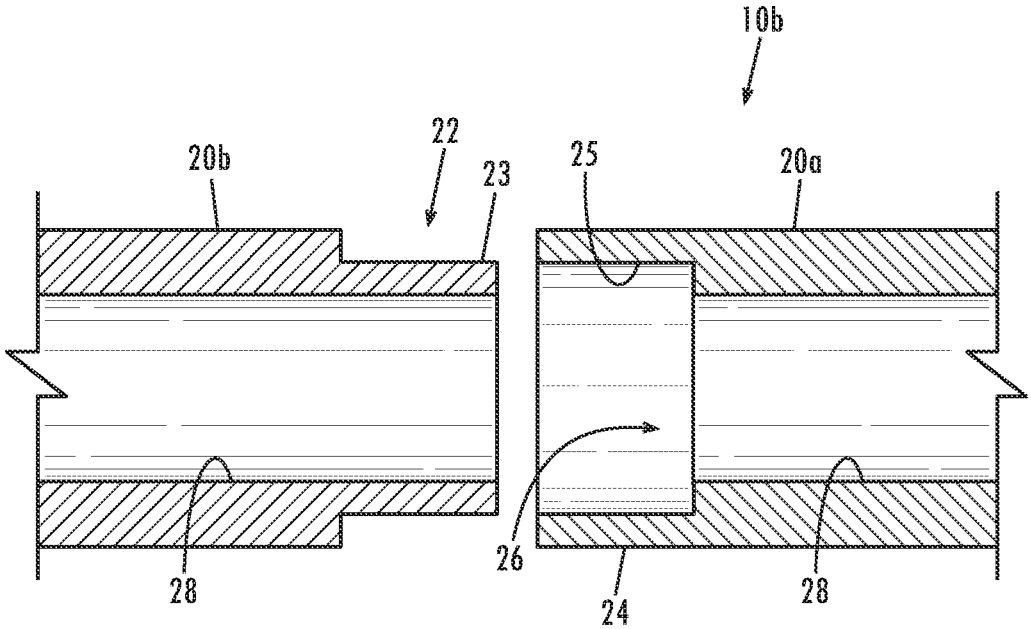
FIGS. 7A and 7B are partial, cross-sectional views of an alternate embodiment of an abdominal exercise device in accordance with the present disclosure.
Figure 7B:
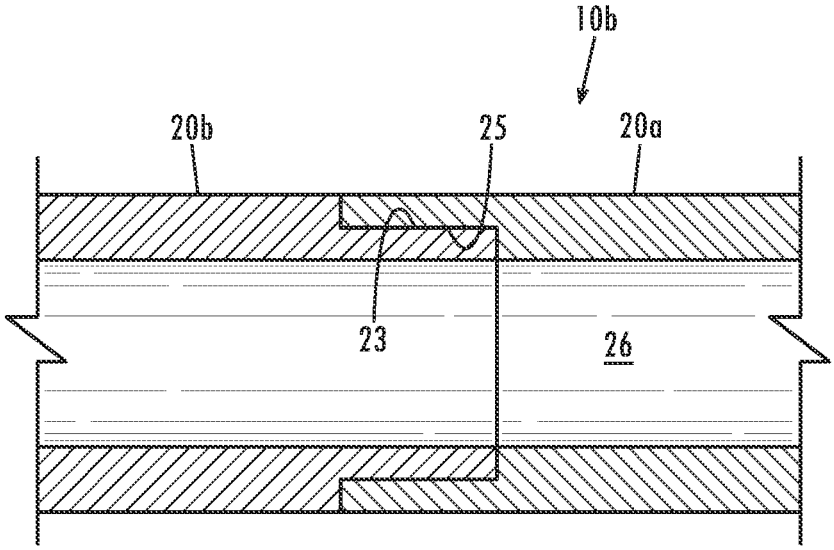

As shown in FIGS. 7A and 7B, in an alternate embodiment of abdominal exercise device 10*b*, connector stub 34 as used with the first embodiment is replaced with a first portion 23, or mounting stub, of second elongated member 20*b* that is received in a second portion 25, or mounting bore, of first elongated member 20*a*. More specifically, exercise device 10*b* differs from exercise device 10*a* in that first portion 23 of second elongated member 20*b* is formed integrally therewith rather than using a separate connector stub to connect the elongated members.

Figure 8A:
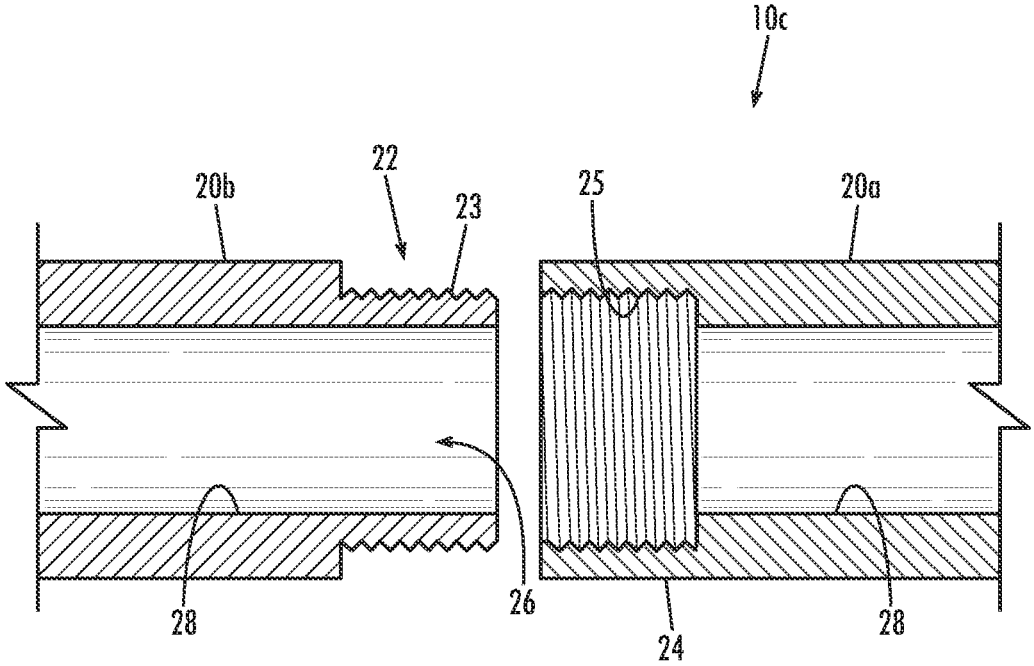
FIGS. 8A and 8B are partial, cross-sectional views of an alternate embodiment of an abdominal exercise device in accordance with the present disclosure.
Figure 8B:
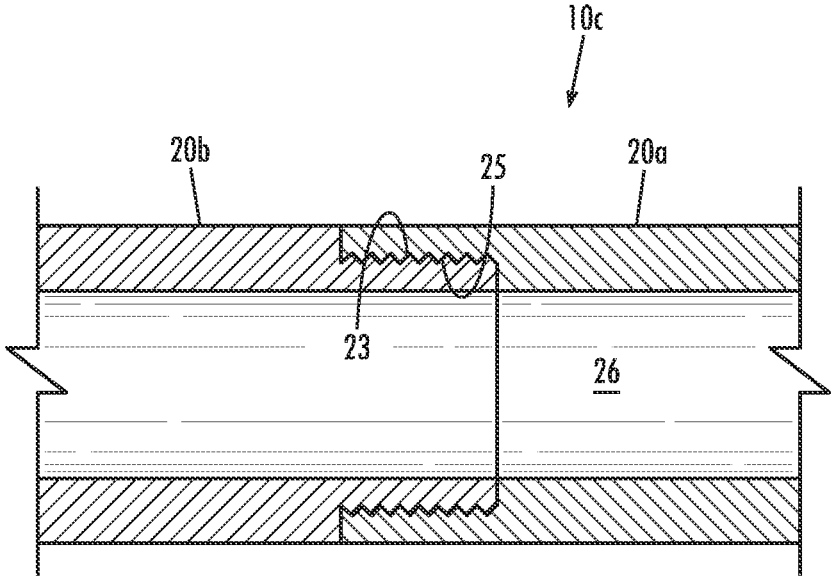
Figure 9A:
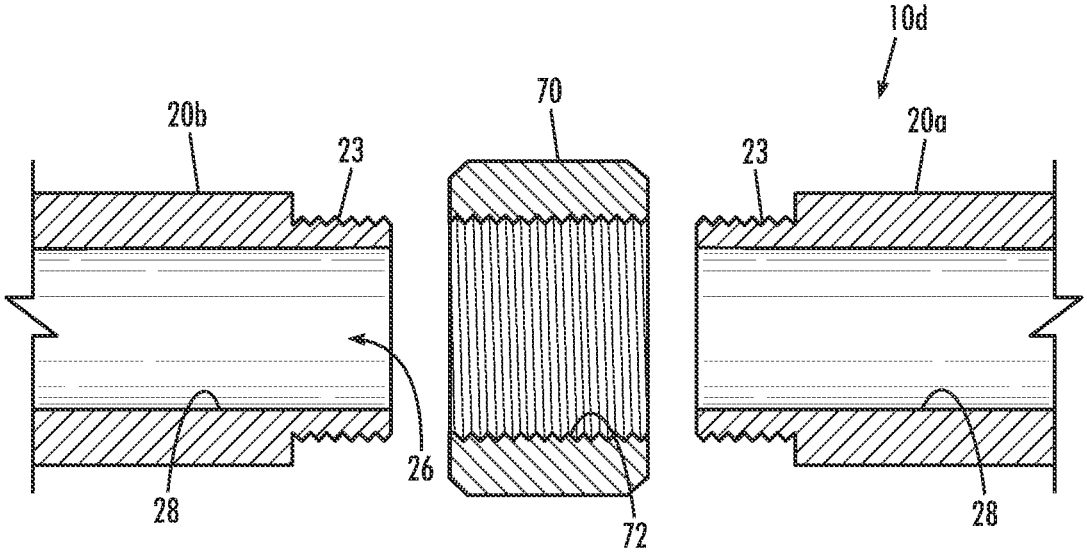
FIGS. 9A and 9B are partial, cross-sectional views of an alternate embodiment of an abdominal exercise device in accordance with the present disclosure.
Figure 9B:
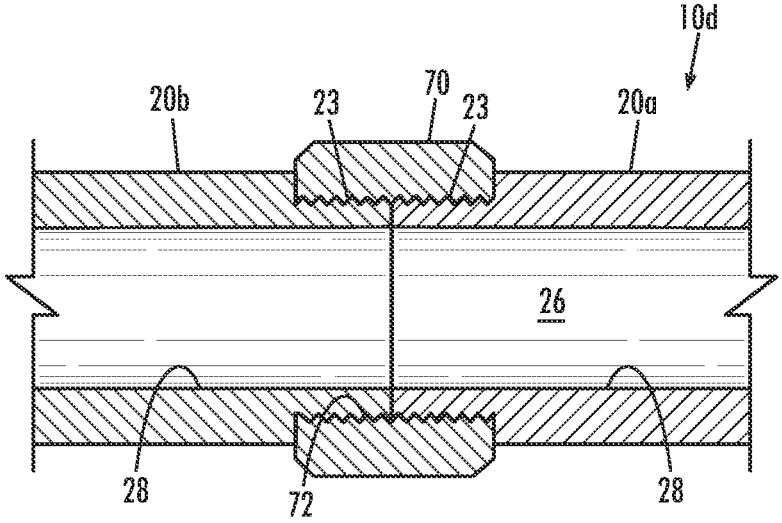

In yet another alternate embodiment of abdominal exercise device 10*c*, the various elongated members used may be assembled with a threaded connection. For example, as shown in FIGS. 8A and 8B, second elongated member 20*b* includes an externally threaded first portion 23, or mounting stub, that is selectively connectable to an internally threaded second portion 25, or mounting bore, of first elongated member 20*a*. Alternately, as shown in FIGS. 9A and 9B, adjacent elongated members 20*a* and 20*b* can each include an externally threaded first portion 23 that is selectively engagable with an internally threaded mounting bore 72 of a threaded nut 70.

Referring now to FIGS. 5 and 6, exercise device 10 is shown secured to mattress 12. More specifically, exercise device 10 is secured to a king size mattress 12 and, as such, four elongated members 20*a*, 20*b*, 20*c* and 20*d* have been coupled together such that the device spans the entire width of the mattress. Note, however, fewer than four elongated members can be used if desired. To perform exercises, a user positions a portion of his body between the elongated members 20*a*-20*d* and the mattress in order to anchor that portion of his body to the mattress. As shown in FIG. 6, the user has positioned both feet under the elongated members in order to perform abdominal exercises. Note, however, the user may also position his head adjacent exercise device 10 and grasp elongated members 20*a*-20*d* with his hands. In this manner, exercises such as leg lifts may be performed.

When not in use, buckle 58 can be used to disconnect the first and second ends of strap 52 such that elongated members 20*a*-2*d* can be positioned off to the side of mattress 12 to allow for its unencumbered use. Alternately, the entire exercise device can be removed simply by removing strap 52 from between mattress 12 and its box spring. As shown in FIG. 4, elongated members 20*a*-20*d* can be readily separated from each other while maintaining strap 52 positioned therethrough. This partial disassembly facilitates repositioning exercise device 10 on the mattress when desired, yet allows the device to be folded for easy storage, carrying in luggage, etc.

While one or more preferred embodiments of the invention are described above, it should be appreciated by those skilled in the art that various modifications and variations can be made in the present invention without departing from the scope and spirit thereof. For example, the cross-sectional shapes of the elongated members may be of any shape found to be suitable for the intended purpose. Additionally, the components of the exercise device may be constructed of any material found to be suitable for the intended purpose. It is intended that the present invention cover such modifications and variations as come within the scope and spirit of the appended claims and their equivalents.

What is claimed is:

1. An exercise device for use with a support surface, comprising:

a first elongated member having a first end, a second end and an elongated bore extending therebetween;

a second elongated member having a first end, a second end and an elongated bore extending therebetween, the first end of the second elongated member being removably secured to the second end of the first elongated member; and an attachment assembly configured to removably secure the first and second elongated members adjacent to the support surface, wherein a user positions a portion of the user's body between the first and second elongated members and the support surface, thereby securing the portion of the user's body in a substantially stationary position.

2. The exercise device of claim 1, the attachment assembly further comprising:

an elongated flexible member having a first end and a second end; and means for connecting the first end of the elongated flexible member to the second end of the elongated flexible member, wherein the elongated flexible member extends through the elongated bores of the first and second elongated members, and the means for connecting includes a first portion connected to the first end of the elongated flexible member and a second portion connected to the second end of the elongated flexible member.

3. The exercise device of claim 2, wherein the elongated flexible member further comprises a strap and the means for connecting comprises a buckle.

4. The exercise device of claim 1, wherein the attachment assembly further comprises:

a strap extending through the elongated bores of the first and second elongated members; and a buckle having a first portion secured to a first end of the strap and a second portion secured to a second end of the strap.

5. The exercise device of claim 4, wherein at least one of the first portion and the second portion of the buckle is selectively removable from the strap.

6. The exercise device of claim 4, wherein at least one of the first portion and the second portion of the buckle is selectively positionable along a length of the strap such that a length of the strap disposed between the first and second portions of the buckle is adjustable.

7. The exercise device of claim 1, wherein the support surface to which the exercise device is secured is a mattress.

8. The exercise device of claim 1, wherein the first and second elongated members are comprised of one of a metal, a fiber reinforced plastic and a fiberglass.

9. The exercise device of claim 1, further comprising a connector stub having a first portion received in the elongated bore of the first elongated member and a second portion that is selectively secured in the elongated bore of the first elongated member.

10. The exercise device of claim 1, wherein the second elongated member further comprises a mounting stub extending from its first end that is removably received in the elongated bore of the elongated bore of the first elongated member.

11. The exercise device of claim 10, wherein the first elongated member further comprises a mounting bore defined by its second end that is configured to removably receive the mounting stub of the second elongated member.

12. The exercise device of claim 1, wherein the first end of the second elongated member includes a threaded stem that is removably received by a threaded bore defined by the second end of the first elongated member.

13. The exercise device of claim 1, further comprising:

a first threaded stem extending outwardly from the second end of the first elongated member;

a second threaded stem extending outwardly from the first end of the second elongated member; and a nut defining a threaded bore, wherein the first and second threaded stems are removably received by the threaded bore of the nut.

14. An exercise device for use with a support surface, comprising:

a first elongated member formed of a rigid material, the first elongated member having a first end, a second end and an elongated bore extending therebetween;

a strap extending through the elongated bore of the first elongated member; and a buckle having a first portion secured to a first end of the strap and a second portion secured to a second end of the strap, wherein the strap and buckle are configured to removably secure the first elongated member adjacent to the support surface, and a user positions a portion of the user's body between the first elongated member and the support surface, thereby securing the portion of the user's body in a substantially stationary position.

15. The exercise device of claim 14, wherein at least one of the first portion and the second portion of the buckle is selectively removable from the strap.

16. The exercise device of claim 14, wherein at least one of the first portion and the second portion of the buckle is selectively positionable along a length of the strap such that a length of the strap disposed between the first and second portions of the buckle is adjustable.

17. The exercise device of claim 14, wherein the support surface to which the exercise device is secured is a mattress.

18. The exercise device of claim 14, wherein the first elongated member is comprised of one of a metal, a fiber reinforced plastic and a fiberglass.

19. The exercise device of claim 14, further comprising a second elongated member having a first end, a second end and an elongated bore extending therebetween, the first end of the second elongated member being removably secured to the second end of the first elongated member.

20. The exercise device of claim 19, further comprising a connector stub having a first portion received in the elongated bore of the first elongated member and a second portion that is selectively secured in the elongated bore of the first elongated member.

21. The exercise device of claim 19, wherein the first end of the second elongated member includes a threaded stem that is removably received by a threaded bore defined by the second end of the first elongated member.

22. The exercise device of claim 19, wherein the second elongated member further comprises a mounting stub extending from its first end that is removably received in the elongated bore of the elongated bore of the first elongated member.

23. The exercise device of claim 22, wherein the first elongated member further comprises a mounting bore defined by its second end that is configured to removably receive the mounting stub of the second elongated member.

24. An exercise device for use with a support surface, comprising:

a first elongated member having a first end, a second end and an elongated bore extending therebetween;

a second elongated member having a first end, a second end and an elongated bore extending therebetween, the first end of the second elongated member being removably secured to the second end of the first elongated member;

an elongated flexible member having a first end and a second end, the elongated flexible member being configured to removably secure the first and second elongated members to the support surface; and means for connecting the first end of the elongated flexible member to the second end of the elongated flexible member, wherein the elongated flexible member extends through the elongated bores of the first and second elongated members, and a user positions a portion of the user's body between the first and second elongated members and the support surface, thereby securing the portion of the user's body in a substantially stationary position.

25. The exercise device of claim 24, wherein the elongated flexible member further comprises a strap and the means for connecting comprises a buckle.

26. The exercise device of claim 25, wherein the strap is comprised of nylon.

27. The exercise device of claim 25, wherein the buckle further comprises a first portion and a second portion and at least one of the first portion and the second portion of the buckle is selectively removable from the strap.

28. The exercise device of claim 25, wherein the buckle further comprises a first portion and a second portion and at least one of the first portion and the second portion of the buckle is selectively positionable along a length of the strap such that a length of the strap disposed between the first and second portions of the buckle is adjustable.

29. The exercise device of claim 24, wherein the support surface to which the exercise device is secured is a mattress.

30. The exercise device of claim 24, wherein the first and second elongated members are comprised of one of a metal, a fiber reinforced plastic and a fiberglass.

31. The exercise device of claim 24, further comprising a connector stub having a first portion received in the elongated bore of the first elongated member and a second portion that is selectively secured in the elongated bore of the first elongated member.

32. The exercise device of claim 24, wherein the second elongated member further comprises a mounting stub extending from its first end that is removably received in the elongated bore of the elongated bore of the first elongated member.

* * * * *

UNITED STATES PATENT AND TRADEMARK OFFICE

CERTIFICATE OF CORRECTION

PATENT NO. : 8,864,637 B2
APPLICATION NO. : 13/360262
DATED : October 21, 2014
INVENTOR(S) : T. Leirer It is certified that error appears in the above-identified patent and that said Letters Patent is hereby corrected as shown below:

Title Page/Abstract (57), line 6, please change "removable secure" to -- removably secure --
Column 4, line 21, please change "support surfaces" to -- to support surfaces --

Signed and Sealed this
Seventeenth Day of May, 2016

Michelle K. Lee

Michelle K. Lee
*Director of the United States Patent and Trademark Office*